United States Patent [19]

Beale

[11] 4,036,018

[45] July 19, 1977

[54] SELF-STARTING, FREE PISTON STIRLING ENGINE

[76] Inventor: William T. Beale, Rte. 4, Box 275, Athens, Ohio 45701

[21] Appl. No.: 661,979

[22] Filed: Feb. 27, 1976

[51] Int. Cl.[2] ..... F02G 1/04

[52] U.S. Cl. ..... 60/520

[58] Field of Search ..... 60/517–526

[56] References Cited

U.S. PATENT DOCUMENTS 3,456,438 7/1969 Meijer ..... 60/520

3,552,120 1/1971 Beale ..... 60/525

*Primary Examiner*—Allen M. Ostrager

*Attorney, Agent, or Firm*—Frank H. Foster

[57] ABSTRACT

A free piston, Stirling engine is provided with seals which permit a limited range of friction-free displacer piston movement for allowing a starting perturbation of displacer piston position. The seal is a sealing ring resiliently mounted to one of two slidably engaged members of the Stirling engine with a limited freedom of movement relative to that member and sealingly slidable along the other member.

14 Claims, 11 Drawing Figures

SELF-STARTING, FREE PISTON STIRLING ENGINE

BACKGROUND OF THE INVENTION

The Stirling cycle engine has been generally known for years and relies on the pressure variations of a closed mass of working fluid, usually a gas such as air or hydrogen, caused by the alternate heating and cooling of the working fluid which is forced by a displacer piston between communicating hot and cold spaces. A more recent development is the Beale type, free piston, Stirling engine having no direct mechanical linkage between its displacer piston and power piston and which is described in U.S. Pat. No. 3,552,120.

Such engines are mechanical oscillators which, for starting, require some initial disturbance in order to bring them from a state of static instability to oscillatory motion. This initial disturbance must be sufficient to cause some movement of the displacer piston of the Stirling engine in order to initiate further and regenerative heating or cooling amd consequent further expansion or contraction of the working gas.

Unfortunately, such initial motion is impeded by the friction between the conventional seals which separate the different spaces within the Stirling engine. Therefore, if the initial disturbance is insufficient to overcome the stick friction of the conventional seals, there may not be enough displacement of the gas to develop sufficient pressure change to continue the motion.

The surrounding environment of engines in some applications may normally provide vibrations of sufficient amplitude to initiate starting. Alternatively, such engines may be started by a sharp tap from an operator or an input from the load. However, such external sources of the initial disturbance are unreliable and there is therefore a need for means to allow the free piston engine to be reliably self-starting.

OBJECTS AND SUMMARY OF THE INVENTION

It is a primary object of the present invention to provide a mechanism which permits the free piston Stirling engine to be self-starting without effecting its steady state operation.

In furtherance of the above object it is a further object of the present invention to provide a free piston Stirling engine in which the displacer piston has an initial, short range of friction free movement.

It is a further object of the present invention to provide such a self-starting mechanism which is simple, inexpensive and does not require periodic adjustment or maintenance.

It is a particular object of the invention to provide a sealing mechanism in a Stirling engine which permits the engine to be self-starting even though it is horizontally aligned and therefore is subject to a seal friction which is greater than in a vertically aligned engine.

Further objects and features of the invention will be apparent from the following specification and claims when considered in connection with the accompanying drawings illustrating several embodiments of the invention.

In summary, the invention is an improved, self-starting, free piston, Stirling engine of the type having a housing enclosing a work space and a second space which are separated by a power piston which is reciprocally mounted in a cylinder and further having a displacer piston slidable in a displacer cylinder, the displacer piston having an attached displacer rod means slidably mounted in a bore means communicating between said work space and said second space. The improvement comprises a first seal member sealingly slideable along one of said means and resiliently attached to the other of said means by a resilient support which permits limited, nonfrictional movement of said seal member relative to the means to which it is attached.

Figure 1:
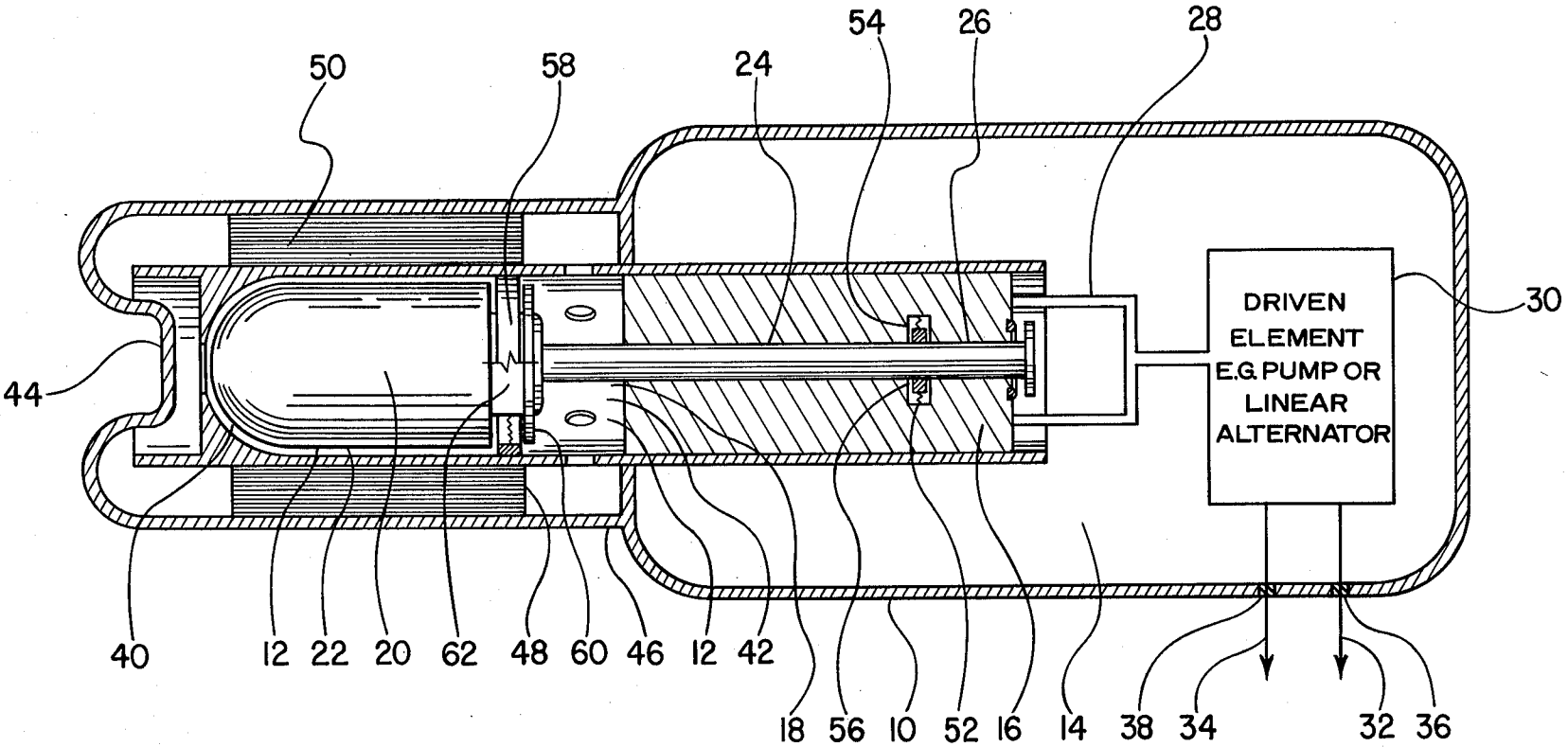
FIG. 1 is a view vertical section illustrating a simplified, free piston, Stirling engine embodying the present invention.

In describing the embodiments of the invention illustrated in the drawings, specific terminology will be resorted to for the sake of clarity. However, it is not intended to be limited to the specific terms so selected and it is to be understood that each specific term includes all technical equivalents which operate in a similar manner to accomplish a similar purpose.

DETAILED DECRIPTION

FIG. 1 illustrates a self-starting, Stirling engine embodying the present invention. The illustrated Stirling engine is a free piston Beale type engine and is shown somewhat diagrammatically. It has a housing 10 enclosing a work space 12 and a buffer or bounce space 14. These spaces are filled with a gas which is suitable for use in a Stirling cycle engine. This gas may be air or for greater efficiency, hydrogen.

The work space 12 is separated from the bounce space 14 by a power piston 16 having a relatively significant mass and reciprocally mounted in a cylinder 18.

A displacer piston 20 of small mass but having a substantial volume is reciprocally slideable in a displacer cylinder 22. The displacer piston 20 has an attached displacer rod means 24 slideably mounted through a bore means 26 formed axially through the power piston 16.

The power piston 16 is connected by a suitable mechanical linkage 28 to a driven element 30 such as, for example, a linear alternator for generating electrical power or a hydraulic pump for mechanical power. Electrical conducting wires or fluid conducting conduits 32 and 34 extend through the wall of the housing 10 but are sealed thereto by means of grommets or other suitable seals 36 and 38. The work space 12 is divided into a hot space 40 and a cold space 42. A heat absorbing surface 44 is positioned adjacent to the hot space 40 and may be provided with conventional heat exchange structures such a fins, loops of tubing or other extended surfaces to improve the efficiency of the heat transfer from a heat source adjacent the heat absorbing surface 44 to the hot space 40.

Similarly, the exterior wall portion 46 which is adjacent the cold space 42 may be provided with heat transfer structure to improve the efficiency of heat transfer to a cooling medium which is located externally adjacent the housing 10 in the region of the wall portion 46.

The hot space 40 is in communication with the cold space 42 through an annular passage 48 formed between the outer housing 10 and the displacer cylinder 22. Desirably an annular regenerator 50 is constructed within this passage 48.

In a Stirling engine as in other engines, it is desirable to provide a seal between reciprocally slidable, cylindrical surfaces. In the free piston Stirling engine it is desirable to provide a seal between the displacer piston rod 24 and the bore 26 through the power piston 16. Similiarly it is desirable to provide a seal between the displacer piston 20 and displacer cylinder 22.

Generally, sealing systems are reversible. Consequently for reciprocating, mating, internal and external cylindrical surfaces, the seal or packing can generally be fixed to either surface and slide back and forth along the other. This principal is also true for seals embodying the present invention.

In FIG. 1, an annular groove 52 is formed in the wall of the axial bore 26. A circular sealing ring 54 surrounds and sealingly slides along the displacer piston rod 24. This sealing ring 54 is resiliently attached to the power piston 16 by means of a resilient support 56 which permits a limited nonfrictional movement of the sealing ring 54 relative to the power piston 16.

The resilient support may be biased so that it is relatively centrally positioned in the groove under static conditions. This bias, if any, will be determined by the normal operating orientation of the engine, the weight of the displacer piston, the seal stick friction, and the contributing support by the displacer piston seal, if any; all with the object of making the displacer piston as free floating as possible within the limits described.

The resilient support is attached to the bottom wall of the annular groove 52. The opposite side walls of the annular groove 52 are spaced further apart than the width of the ring so that the ring is permitted a limited range of axial movement within the groove 52. For purposes of improved illustration, clearances have been exaggerated. Preferably the opposite side walls of the groove 52 are formed to sealingly mate against the sides of the ring 54 so that the ring can move into sealing engagement with a wall of the groove after limited movement.

As an alternative to the sealing engagement of the ring against the wall of the groove, the resilient support itself may be a substantially fluid impervious corrugated disk and be sealingly attached to the bottom wall of the groove to thereby maintain the seal.

The displacer piston 20 may also be provided with a seal embodying the present invention. For example, FIG. 1 illustrates a sealing ring 58 mounted by a corrugated resilient support 60 to the bottom wall of a groove 62.

Figure 2:
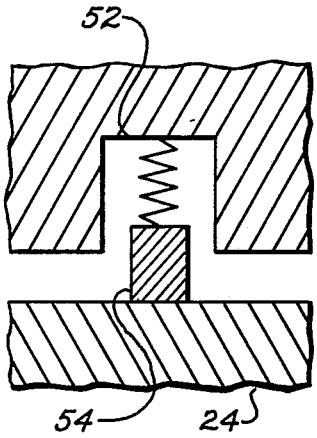
FIGS. 2 through 4 illustrate in section the operation of a seal embodying the present invention.
Figure 3:
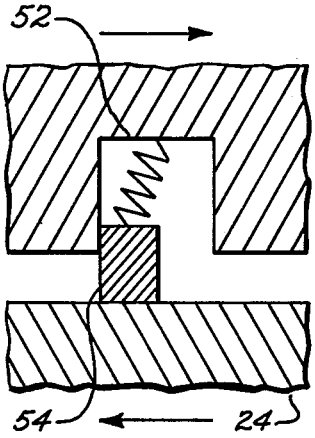
Figure 4:
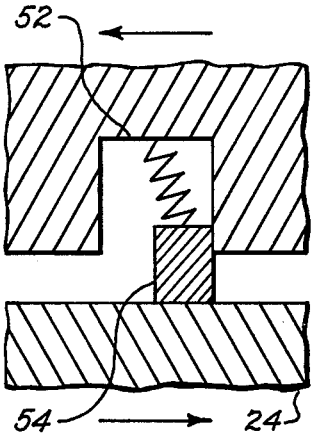
Figure 5:
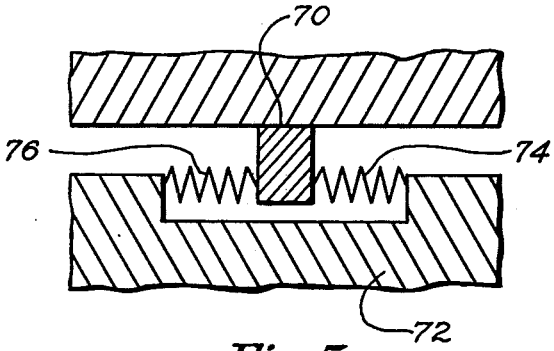
FIG. 5 is a view in section of an alternative seal embodying the present invention.

FIGS. 2 through 4 illustrate the operation of a seal embodying the present invention. In order to start the free piston Stirling engine it is necessary to initiate some movement of the displacer piston in order to force a movement of some of the working gas between the cold space and hot space. Any significant movement of working gas from one space to the other will cause an additional volume of gas to be heated or cooled thus causing a greater pressure differential between the working space and the bounce space. This pressure acts on and moves the displacer piston rod, in turn causing further gas movement, and thus starting the engine.

The seal embodying the present invention permits this initial displacer piston movement to occur without being impeded or retarded by the stick friction of the seal. Thus, the displacer piston can move without requiring the seal to slide along its mating sealing surface.

FIG. 2 illustrates the seal 54 in an intermediate static position. If the pistons are aligned along a vertical axis, the sealing ring 54 may be somewhat vertically off center in the groove 52 because of the weight of the pistons. This can be offset by bias of the resilient support.

Initial heating of the heat absorbing surface 44 begins the heating of gas in the hot space 40 and causes some gas convection flow.

The disturbance caused by the flow of convection currents within the hot space provides the needed small movement or perturbation of the displacer piston to regeneratively initiate further movement and consequent starting of the engine. The substantial movement of the piston during steady state operation will cause the sealing ring 54 to slide to and fro between the opposite side walls of the groove 52 sealingly seating against the side wall during most of the piston movement as illustrated in FIGS. 3 and 4.

Therefore, complete sealing between the ring and the opposite sliding surfaces may be accomplished by the seating of the ring against the wall of the groove. Alternatively the sealing may be accomplished by using a fluid impervious, resilient support 60 as described above.

FIGS. 5 through 11 illustrate alternative seal mechanisms embodying the present invention. For example, the seal 70 of FIG. 5 may be resiliently attached to sliding member 72 by means of a plurality of circularly spaced pairs of axially aligned springs 74 and 76 or other resilient means spaced about the cylindrical surface and extending between the ring and the walls of the groove. For complete sealing, the resilient means may be a pleated, annularly ridged, impervious sheet material forming a bellows.

Figure 6:
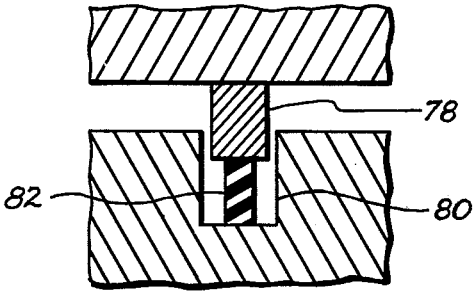
FIG. 6 is a view in section of still another alternative seal embodying the present invention.

FIG. 6 illustrates a sealing ring 78 mounted to a groove 80 by means of an elastic ring 82.

Figure 7:
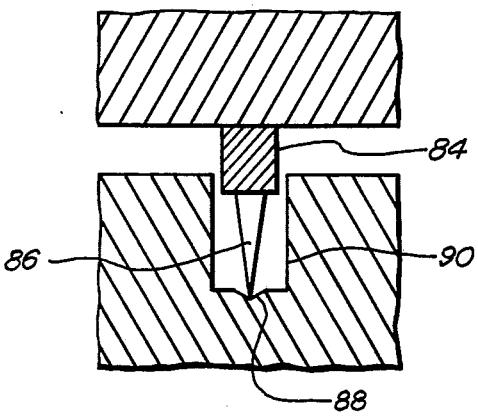
FIG. 7 is a view in section of still another alternative seal embodying the present invention.
Figure 8:
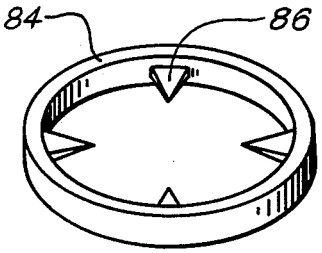
FIG. 8 is a view in perspective of the sealing member illustrated in FIG. 7.

FIG. 7 illustrates a sealing ring 84 having a plurality of inwardly directed radial arms, such as arm 86, engaging a minor V groove 88 formed annularly around the bottom wall of the groove 90. This ring 84 with its radial arms is further illustrated in FIG. 8.

Figure 9:
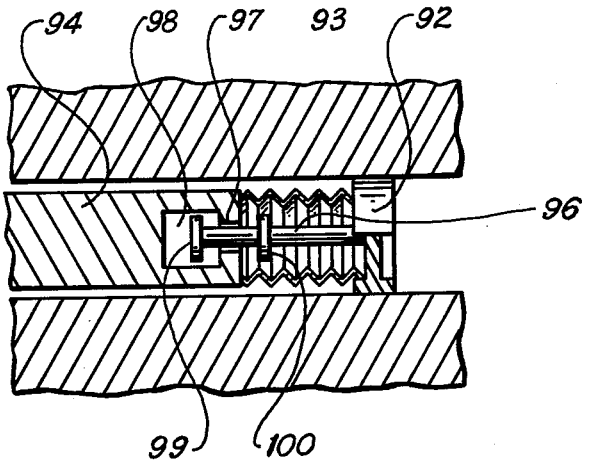
FIG. 9 is yet another alternative seal embodying the present invention.

FIG. 9 illustrates a seal 92 mounted to a displacer rod 94 by means of a circular bellows 93 attached at one end to the sealing ring 92 and at the other end to the bottom end of the displacer piston rod 94. A pin 96 is rigidly attached at one end to the seal 92 and extends through an opening 97 in the bottom of the displacer piston rod 94 and into a hollow space 98 formed therein. The pin 96 is provided with a pair of stops 99 and 100 to limit the flexing and distortion of the bellows 93.

Figure 10:
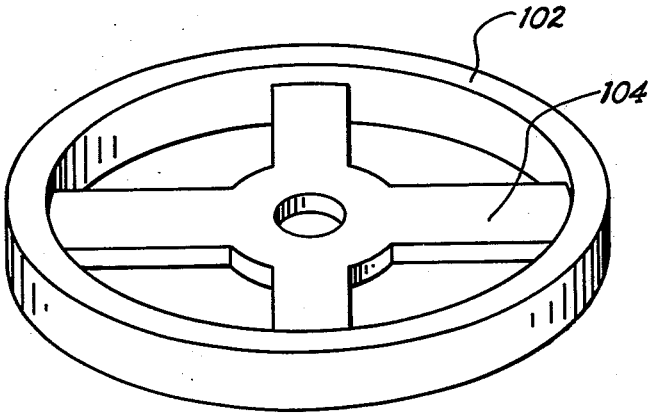
FIG. 10 is a view in perspective of yet another seal embodying the present invention.
Figure 11:
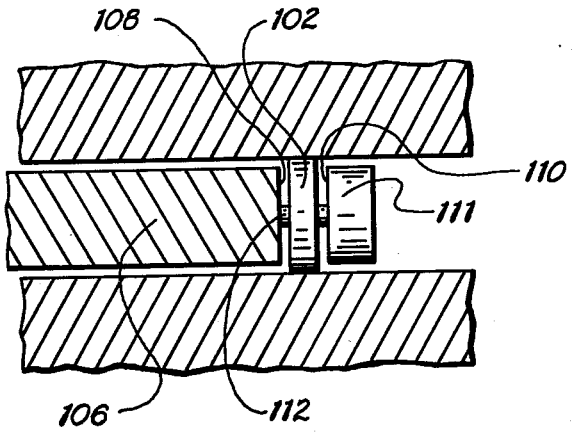
FIG. 11 is a view in section illustrating the installed position of the seal of FIG. 10.

FIGS. 10 and 11 illustrate a sealing ring 102 with flexible radial arms 104 and mounted to the end of the displacer piston rod 106 so that it may flex into sealing engagement with the bottom edge 108 of the displacer piston rod 106 and the edge 110 of a cap member 111 fixed to the displacer piston rod 106 by means of a central axial pin 112.

It is to be understood that while the detailed drawings and specific examples given describe preferred embodiments of the invention, they are for the purpose of illustration only, that the apparatus of the invention is not limited to the precise details and conditions disclosed in that various changes may be made therein without departing from the spirit of the invention which is defined by the following claims.

What is claimed is:

1. A self-starting, free piston Stirling cycle engine having a housing enclosing a work space and a second space which are separated by a power piston reciprocally mounted in a cylinder and further having a displacer piston slidable in a displacer cylinder, the displacer piston having an attached displacer rod means slidably mounted to a bore means communicating between said work space and said second space, wherein the improvement comprises a first seal member sealingly slidable along one of said means and resiliently attached to the other of said means by a resilient support which permits limited, nonfrictional movement of said seal member relative to the means to which it is attached.

2. An engine according to claim 1 wherein said seal member comprises a sealing ring and wherein one of said means is formed with an annular groove in which said resilient support is attached, said groove having opposite side walls spaced further than the width of said ring and against which said ring can move into sealing engagement.

3. An engine according to claim 2 wherein said resilient support includes a plurality of radial arms engaging the bottom wall of said groove.

4. An engine according to claim 2 wherein said resilient support comprises a corrugated annular disk.

5. An engine according to claim 2 wherein said resilient support is biased in opposition to the weight of the displacer piston for supporting the displacer piston with the sealing ring spaced from the opposite side walls of said groove.

6. An engine according to claim 2 wherein said resilient support comprises axially aligned spring members extending between said ring and the walls of said groove.

7. An engine according to claim 1 wherein said resilient support is substantially fluid impervious and is sealingly attached to said other of said means and to said seal member.

8. An engine according to claim 7 wherein said resilient support is a corrugated, annular disk.

9. An engine according to claim 7 wherein said seal member comprises a sealing ring and wherein one of said means is formed with an annular groove in which said resilient support is attached, said groove having opposite side walls spaced further than the width of said ring and against which said ring can move into sealing engagement.

10. An engine according to claim 7 wherein said resilient support comprises a cylindrical, annularly ridged bellows.

11. An engine according to claim 7 wherein said resilient support comprises of an elastic ring.

12. An engine according to claim 1 wherein the improvement further comprises a second seal member sealingly slidable along one of either of said displacer piston or its cylinder and attached to the other by a resilient support which permits limited, nonfrictional movement of said second seal member relative to the displacer cylinder or piston to which it is attached.

13. An engine according to claim 12 wherein said seal members each comprise a sealing ring and wherein said resilient support is mounted in an annular groove, said groove having opposite side walls spaced further than the width of said ring and against which said ring can move into sealing engagement.

14. An engine according to claim 12 wherein each of said resilient supports is substantially fluid impervious.

* * * * *